US007553168B2

(12) United States Patent
Zhu et al.

(10) Patent No.: US 7,553,168 B2
(45) Date of Patent: Jun. 30, 2009

(54) ELECTRICAL CONNECTOR ASSEMBLY

(75) Inventors: Yu Zhu, ShenZhen (CN); Yu-San Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/074,763

(22) Filed: Mar. 5, 2008

(65) Prior Publication Data

US 2008/0220660 A1 Sep. 11, 2008

(51) Int. Cl.
*H01R 12/00* (2006.01)

(52) U.S. Cl. ..... 439/74; 439/565; 439/570

(58) Field of Classification Search ..... 439/74, 439/565–567, 570

See application file for complete search history.

(56) References Cited

U.S. PATENT DOCUMENTS

| | | | | |
|---|---|---|---|---|
| 5,145,407 | A * | 9/1992 | Obata et al. | 439/567 |
| 5,207,593 | A * | 5/1993 | Bogiel | 439/352 |
| 5,464,355 | A * | 11/1995 | Rothenberger | 439/559 |
| 6,250,938 | B1 * | 6/2001 | Tung | 439/160 |
| 7,384,274 | B1 * | 6/2008 | Chen et al. | 439/74 |
| 7,458,822 | B2 * | 12/2008 | Ono | 439/74 |

* cited by examiner

*Primary Examiner*—Truc T Nguyen
(74) *Attorney, Agent, or Firm*—Wei Te Chung

(57) ABSTRACT

An electrical connector assembly, comprises a terminal block defining a plurality of receiving passageways therein, a plurality of terminals assembled to the receiving passageways, and a fastening element assembled to the terminal block. Each terminal comprises a main portion, a tail portion extending rearward from the main portion and a contacting portion extending forwardly from the base portion. The fastening element comprises a base portion, a pair of resilient arms extending away from the base portion, and a pair of hooks formed at distal ends of the pair resilient arms.

18 Claims, 6 Drawing Sheets

ELECTRICAL CONNECTOR ASSEMBLY

BACKGROUND OF THE INVENTION

1. Field of the Invention

The present invention relates to an electrical connector assembly, and particularly to an electrical connector assembly having an improved latching means.

2. Description of the Prior Art

An electrical connector assembly is usually required to establish a electrical connection between a pair of printed circuit boards and in some time positioned on a electronic device, such as a hard disk drive. Such connector usually comprises an insulating housing, a plurality of terminals received in the insulating housing. In traditional manner, a plurality of bolts and a plurality of nuts are employed to lock the connector with an electronic device. In assembly, the plurality of terminals are assembled into the insulating housing. The plurality of bolts pass a plurality of corresponding screws defined in the hard disk drive, and then the plurality of nuts are assembled with the bolts.

However, said configuration of the electrical connector has several defects in many ways. Such as space-consuming against the miniature trend, complicated to be manufactured, inefficient in assembling.

Hence, an improved electrical connector assembly is desired to overcome the disadvantages of the prior art.

BRIEF SUMMARY OF THE INVENTION

Therefore, a main object of the present invention is to provide an electrical connector assembly with simple structure and high efficiency in process of assembly.

To fulfill the above-mentioned object, an electrical connector assembly according to the present invention comprises a terminal block defining a plurality of receiving passageways therein, a plurality of terminals assembled to the receiving passageways, and a fastening element assembled to the terminal block. Each terminal comprises a main portion, a tail portion extending rearward from the main portion and a contacting portion extending forwardly from the base portion. The fastening element comprises a base portion, a pair of resilient arms extending away from the base portion, and a pair of hooks formed at distal ends of the pair resilient arms.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
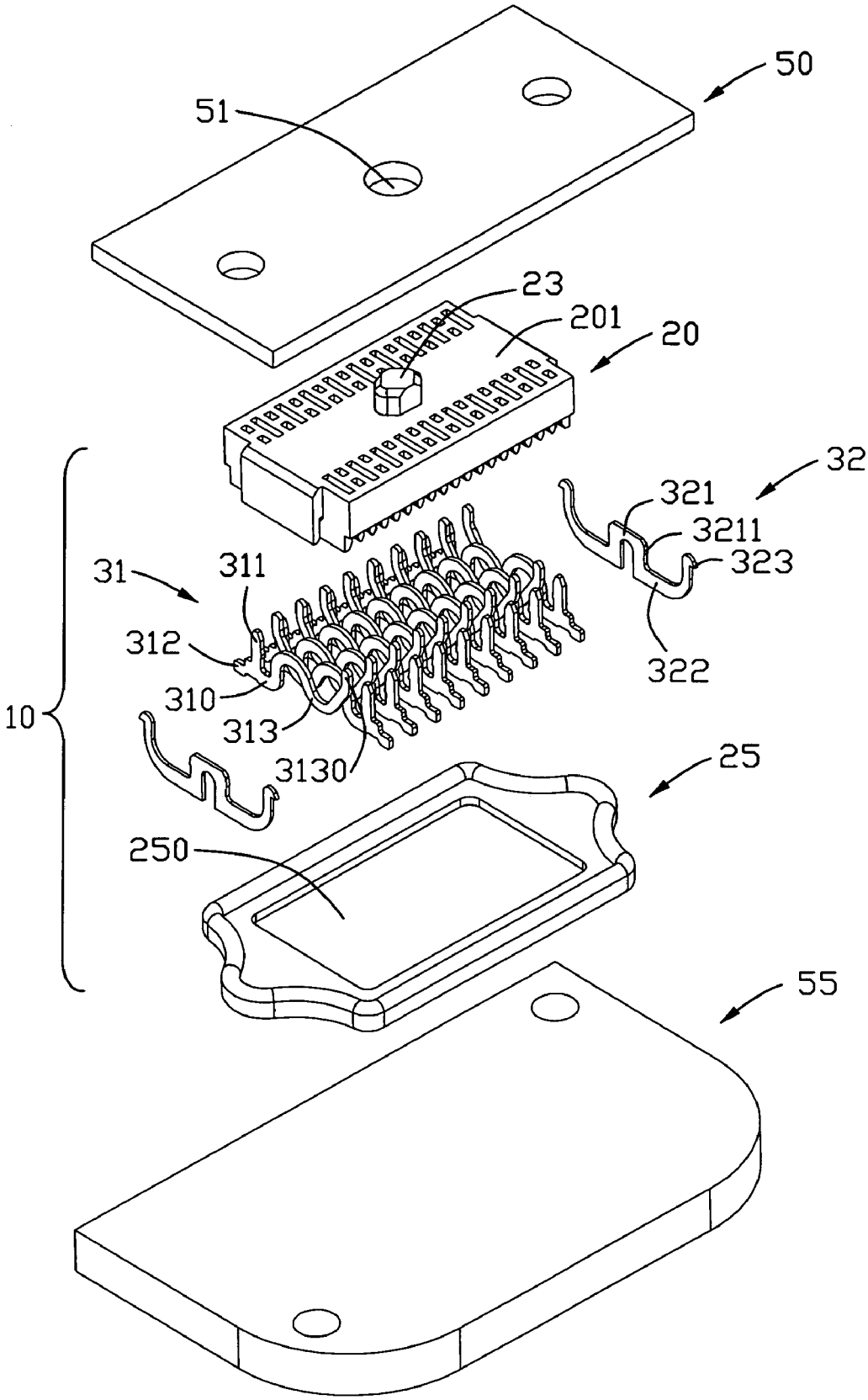
FIG. 1 is an exploded, perspective view of an electrical connector assembly according to the present invention with a pair of circuit boards.
Figure 2:
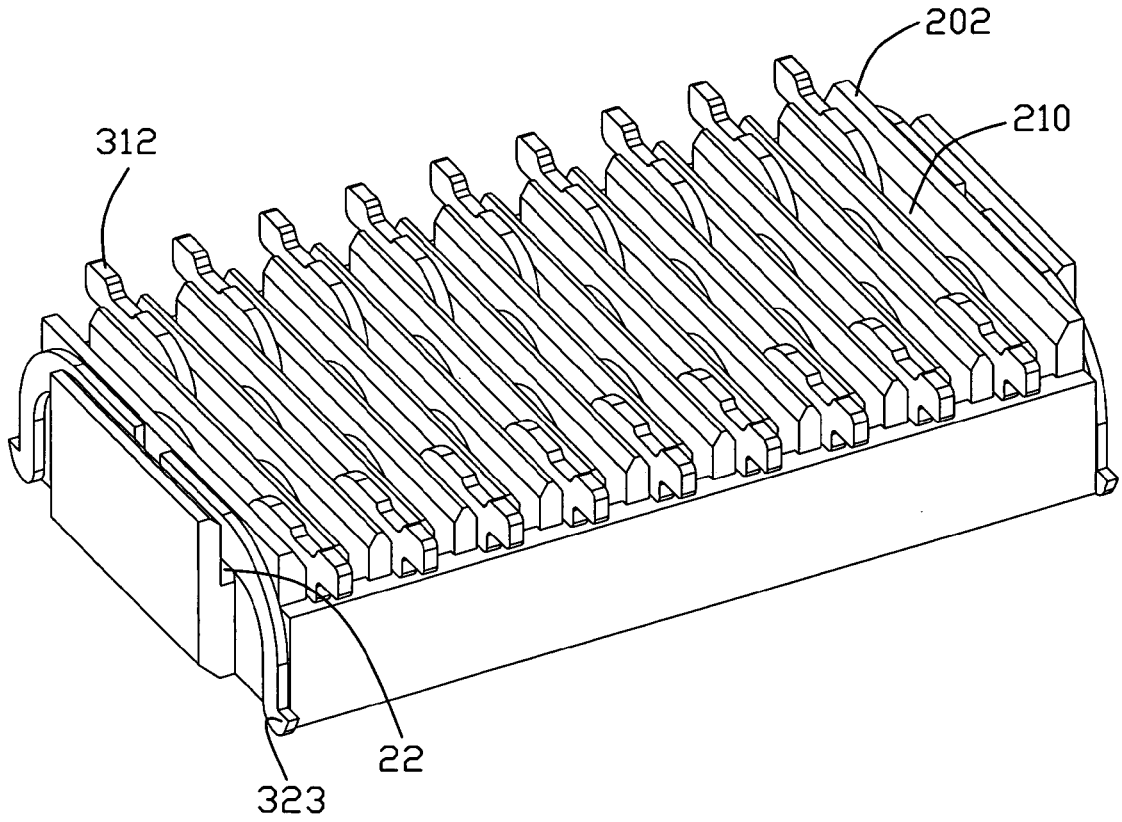
FIG. 2 is an assembled, perspective view of an electrical connector assembly shown in FIG. 1, without an insulating member.
Figure 3:
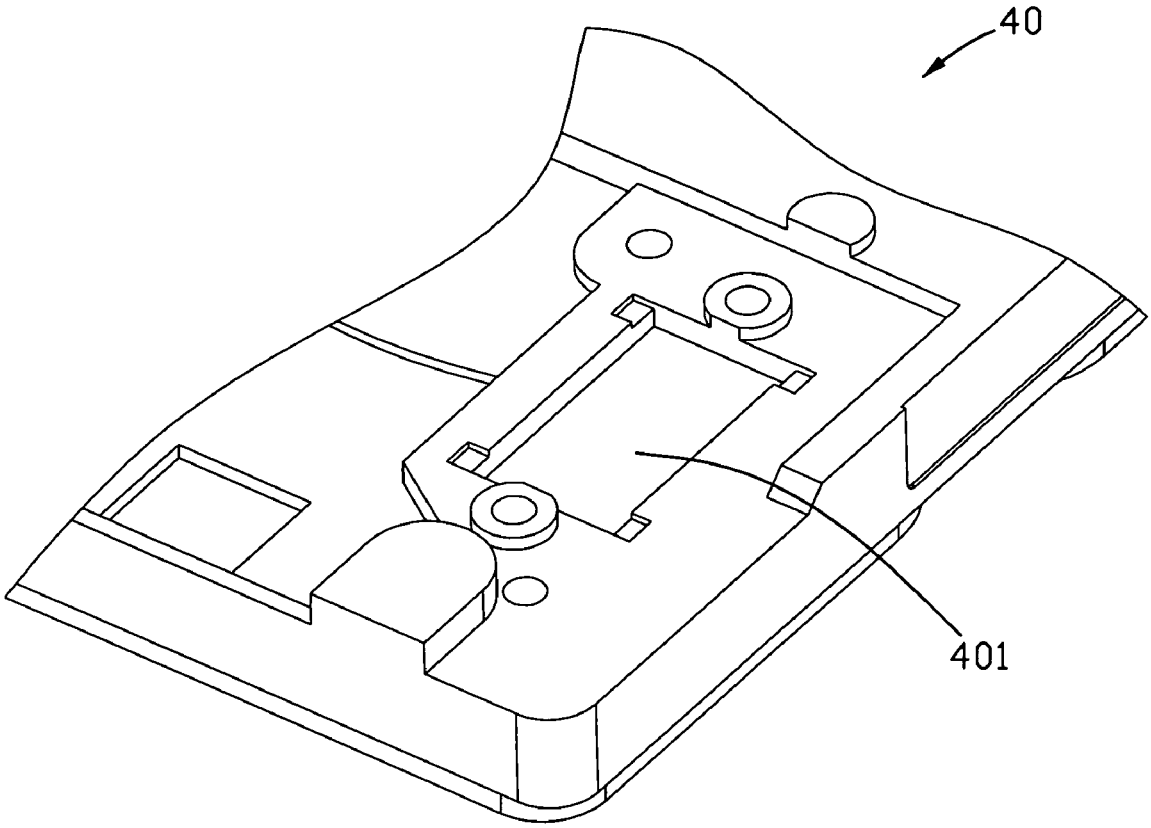
FIG. 3 is a perspective view of a hard disk driver.
Figure 4:
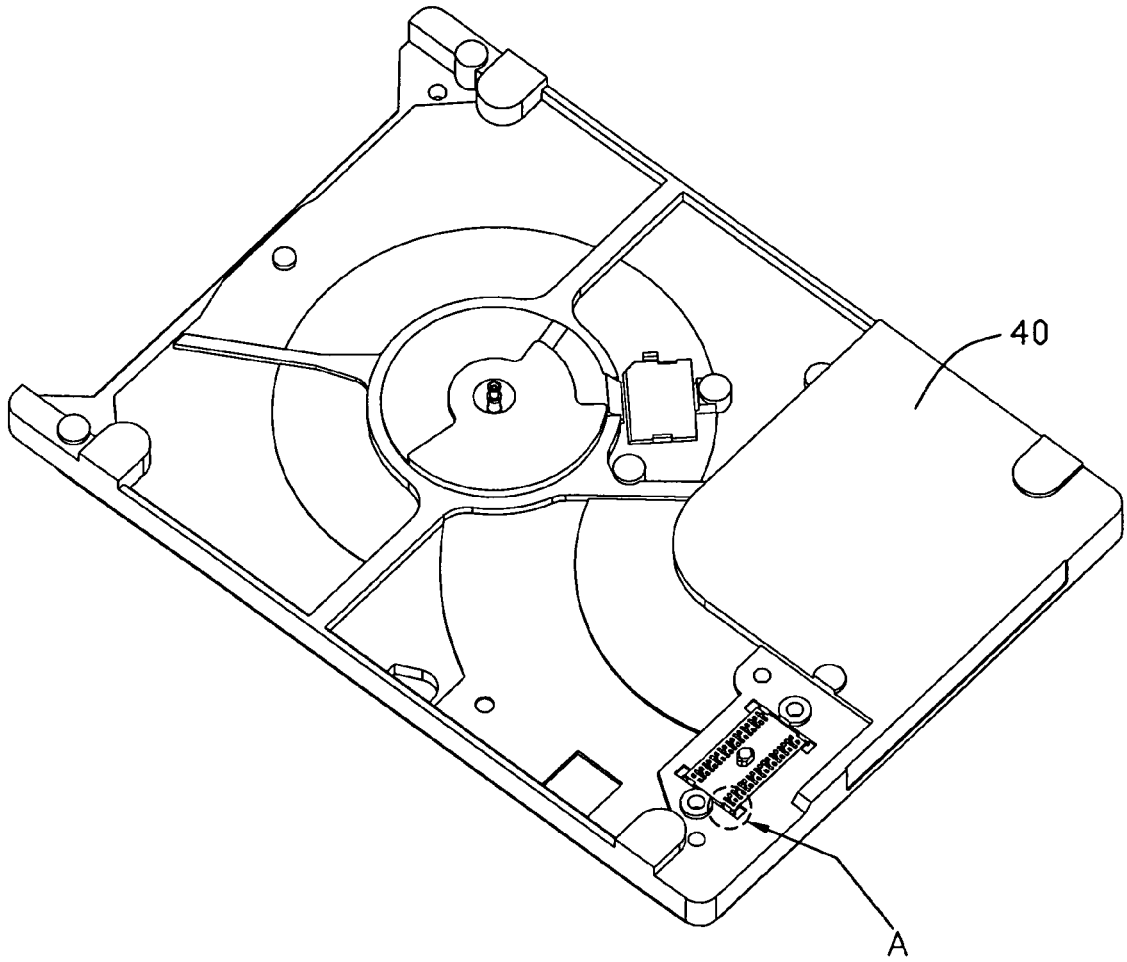
FIG. 4 shows the electrical connector assembly according to the present invention assembled with the hard disk driver.
Figure 5:
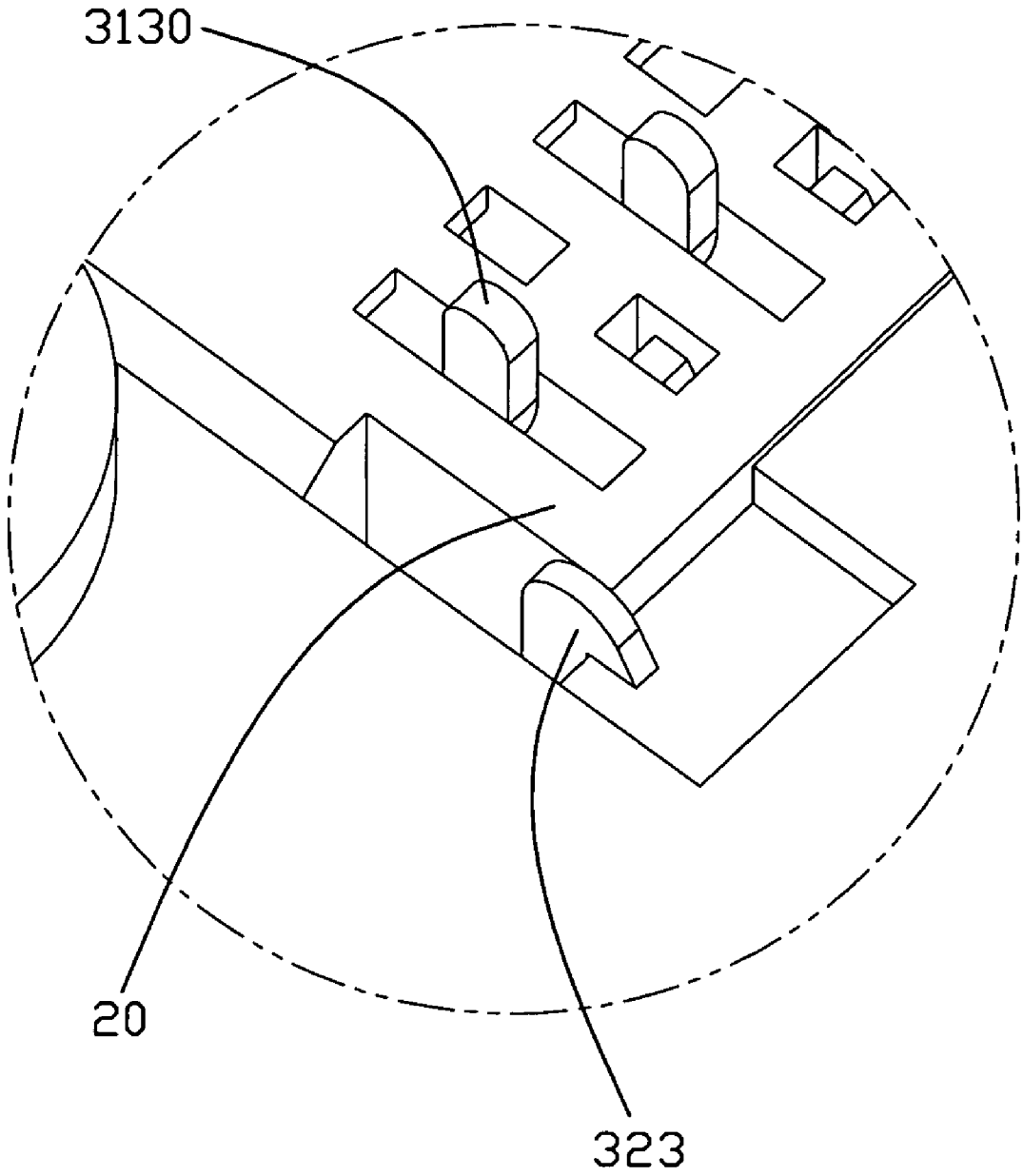
FIG. 5 shows partially enlarged view of FIG. 4.

Referring to FIGS. 1-3, an electrical connector assembly 10 according to the present invention is adapted for mounting on a hard disk drive 40 and electrical connecting with a pair of circuit board 50, 55. The electrical connector assembly 10 comprises an terminal block 20, a plurality of terminals 31 disposed therein, a pair of fastening elements 32 located at two sides thereof and an insulating element 25 peripherally enclosing the terminal block 20. The hard disk driver 40 defines a receiving opening 401. The pair of the circuit boards 50, 55 respectively defines a plurality of conductive elements (not shown) and locates the upper and lower surface of the hard disk driver 40. The circuit board 50 further defines a through hole 51 at the intermediate portion thereof.

The terminal block 20 is substantially elongated and rectangular, and defines a mating face 201 for engaging with the circuit board 50, a engaging face 202 opposite to the mating face 201 and engaging with the circuit board 55, a plurality of receiving passageways 210 extending through the mating face 201 and the engaging face 202 for receiving the plurality of terminals 31, a pair of retaining slots 22 located at two short side of the terminal block for securing the pair of fastening elements 32 and a post 23 upwardly protruding from the upper surface thereof. The receiving passageways 210 communicate in the engaging face 202 and are divided into two rows in the mating face 201. The post 23 is located between the two rows of the receiving passageways 210. The retaining slots 22 extends along a direction from the engaging face 202 to the mating face 201 and defines an inner groove (not shown).

Figure 6:
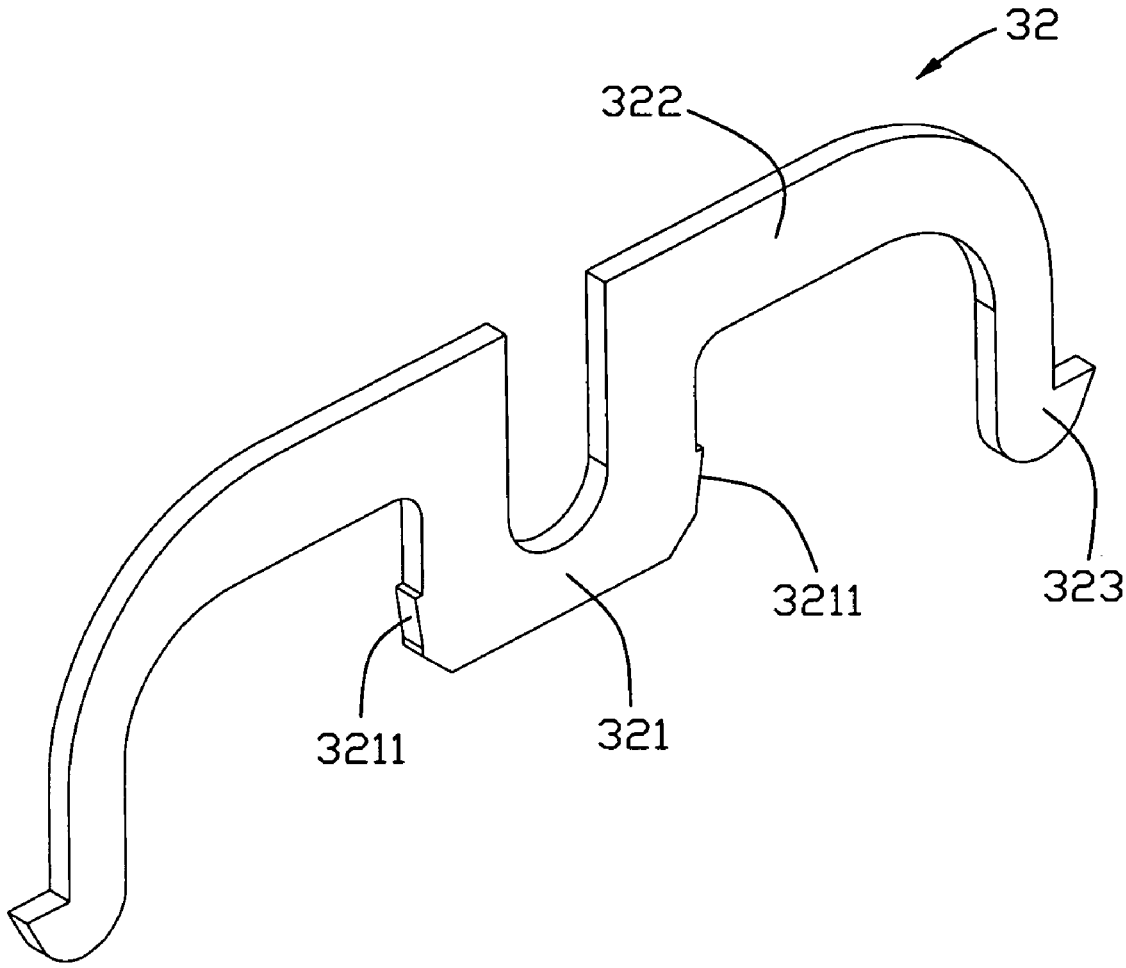
FIG. 6 is a perspective view of a fastening element of the electrical connector assembly according to the present invention.

Referring to FIG. 6, each terminal 31 defines a main portion 310, a tail portion 312 extending rearward from the main portion 310 for surface mounting on the circuit board 55, a retention portion 311 extending upwardly from the main portion 310 and a resilient arm 313 extending forwardly from the main portion 310. The resilient arm 313 is of S-shape and defines a contacting portion 3130 at the distal end thereof.

Each fastening element 32 is symmetrical shaped, and comprises a U-shaped base portion 321, a pair of resilient arm 322 symmetrically extending away from the distal end of the base portion 321, and a pair of hook 323 respectively and outwardly extending from the pair of resilient arm 322. The base portion 321 further defines a pair of protrusion for engaging with the retaining slot 22.

The insulating member 25 is substantially of rectangular shape, and comprises an opening 250 for coupling with out periphery of the terminal block 20.

Referring to FIG. 1-6, in assembly, the plurality of terminals 31 are assembled into the terminal block 20 with the retention portions 311 positioned in the receiving passageways 210, the tail portions 312 projecting out of the engaging face 202 for engaging with the circuit board 55, the contacting portions 3130 projecting out of the mating face 201 for mating with the circuit board 50. Then, the fastening elements 32 are assembled into the retaining slots 22 with base portions 321 receiving in the retaining slots 22, the protrusions 3211 of the base portions 321 interferential locking with the inner groove for preventing the base portions 321 from escaping away from the retaining slots 22, the resilient arms 322 located at two short sides of the terminals block 20, and the hooks 323 respectively projecting outside the long sides of the terminal block 20. The insulating member 25 moves along a direction from the engaging face 202 to the mating face 201 to enclose the out periphery of the terminal block 20 and locate between the mating face and a plane in which the plurality of tail portions locate for preventing tail portions 312 of the terminals 31 from electrically connecting with the metal shell of the hard disk driver 40, the electrical connector assembly 10 with the insulating member 25 together assembled with the opening 401 of the hard disk driver 40 from the bottom of the hard disk driver 40, with the resilient arms 322 resisting the inner face of the opening 301, the hooks 323 locking the shell of the hard disk driver 40. Thus, the electrical connector assembly 10 can easily assemble with the hard disk driver 40 in a snap-locking manner. Furthermore, the fastening elements 32 with simple structure are easy to be mass produced.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

a primary part defining an opening extending through both opposite first and second surface;

a terminal block to be received through the opening defining a plurality of receiving passageways therein;

a plurality of terminals assembled to the receiving passageways, each terminal comprising a main portion, a tail portion extending rearward from the main portion and a contacting portion extending forwardly from the base portion;

a fastening element assembled to the terminal block, the fastening element comprising an inverse U-shaped base portion, a pair of resilient arms extending away and upwardly from ends of the inverse U-shaped base portion, and a pair of hooks formed at distal ends of the pair resilient arms to latch to the first face through the opening of the primary part.

2. The electrical connector assembly as claimed in claim 1, wherein the terminal block is elongated and rectangular, and comprise at least a retaining slot for receiving the least fastening element, a mating face, an engaging face parallel to the mating face, the plurality of receiving slots extending through the mating face and the engaging face for receiving the plurality of terminals.

3. The electrical connector assembly as claimed in claim 2, wherein each of the retaining slot of the terminal block defines an inner groove, and each U-shaped base portion defines a pair of protrusions at two sides thereof engaging with the inner groove.

4. The electrical connector assembly as claimed in claim 3, wherein the plurality of receiving passageways communicate in the engaging face and are divided into two rows in the mating face.

5. The electrical connector assembly as described in claim 4, wherein each terminal further defines a retention portion upwardly extending from the base portion and positioned in the receiving passageways and a S-shaped resilient arm extending forwardly from the main portion, said contacting portions are respectively formed at distal ends of the resilient arms of the terminals.

6. The electrical connector assembly as claimed in claim 5, wherein the contacting portions of the terminals project above the mating face, the tail portions of the terminals are located below the engaging face.

7. The electrical connector assembly as claimed in claim 6, further comprising an insulating member with substantially rectangular shape, assembled to the terminal block.

8. The electrical connector assembly as claimed in claim 7, wherein the insulting member defines an opening configured to enclose out periphery of the terminal block.

9. The electrical connector assembly as claimed in claim 8, wherein the insulating member locate between the mating face and a plane in which the tail portions of the terminals locate.

10. An electrical connector assembly, comprising:

a primary part defining an opening extending through both opposite first and second surface;

a terminal block to be received through the opening defining a mating face, an engaging face opposite to the mating face and a plurality of receiving passageways extending through the mating face and the engaging face;

a plurality of terminals assembled to the receiving passageways, and each comprising a tail portion located below the engaging face and a contacting portion projecting above the mating face;

a fastening element assembled to the terminal block, the fastening element comprising an inverse U-shaped base portion, a pair of resilient arms extending outwardly and upwardly from ends of the inverse U-shaped base portion, and a pair of hooks formed at distal ends of the pair resilient arms to latch to the first face through the opening of the primary part.

11. The electrical connector assembly as claimed in claim 10, wherein the terminal block is elongated and rectangular, and defines at least a retaining slot at two sides thereof along the elongated direction.

12. The electrical connector assembly as claimed in claim 10, further comprising an insulating member with substantially rectangular shape, defining an opening configured to couple with out periphery of the terminal block.

13. The electrical connector assembly as claimed in claim 11, wherein each of the retaining slot of the terminal block defines an inner groove, and each U-shaped base portion defines a pair of protrusions at two sides thereof engaging with the inner groove.

14. The electrical connector assembly as claimed in claim 10, wherein the plurality of receiving passageways communicate in the engaging face and are divided into two rows in the mating face.

15. The electrical connector assembly as described in claim 14, wherein each terminal defines a main portion, a retention portion upwardly extending from the main portion and positioned in the receiving passageways and a S-shaped resilient arm extending forwardly from the main portion.

16. The electrical connector assembly as claimed in claim 15, wherein said contacting portions are respectively formed at distal ends of the resilient arms of the terminals, said tail portions are respectively extending rearward from the main portion.

17. The electrical connector assembly as claimed in claim 12, wherein the insulating member locate between the mating face and a plane in which the tail portions of the terminals locate.

18. An electrical connector comprising:

a primary part defining an opening extending through both opposite first and second faces;

a terminal block defining a contour dimensioned and configured to be snugly received in the through opening, and further defining opposite third and fourth surfaces adjacent to the corresponding first and second faces, respectively;

a plurality of terminals disposed in the terminal block, each of said terminals defining a compression end adjacent to the third surface and a soldering end adjacent to the fourth face;

an insulator attachably surrounding a peripheral of the terminal block; and at least one fastening device retained to the terminal block and defining at least one resilient hook;

wherein the fastening element comprising an inverse U-shaped base portion, a pair of resilient arms extending outwardly and upwardly from ends of the inverse U-shaped base portion; and wherein the at lease resilient hook formed at distal end of the pair resilient arms to latch to the first face through the opening of the primary part.

* * * * *